US007055465B1

(12) United States Patent
Huang et al.

(10) Patent No.: US 7,055,465 B1
(45) Date of Patent: Jun. 6, 2006

(54) WATER HEATER HAVING WASTE GAS DISPOSAL STRUCTURE

(76) Inventors: Hsin-Ming Huang, 120, Da Hsing St., Taichung (TW); Kuan-Chou Lin, 11F-1, No. 23, Lane 98, Kung Yeh Chu First Rd., Fu En Li, Taichung (TW)

( * ) Notice: Subject to any disclaimer, the term of this patent is extended or adjusted under 35 U.S.C. 154(b) by 0 days.

(21) Appl. No.: 11/130,993

(22) Filed: May 17, 2005

(51) Int. Cl.
*F22B 1/18* (2006.01)

(52) U.S. Cl. ..... 122/4 D; 122/7 R
(58) Field of Classification Search ..... 122/4 D, 122/7 A, 13.01, 13.3, 38, 5.51
See application file for complete search history.

(56) References Cited

U.S. PATENT DOCUMENTS 5,291,859 A * 3/1994 Brinck et al. ..... 122/7 R
6,745,724 B1 * 6/2004 Hughes et al. ..... 122/44.2

* cited by examiner

*Primary Examiner*—Gregory Wilson
(74) *Attorney, Agent, or Firm*—Alan D. Kamrath; Nikolai & Mersereau, P.A.

(57) ABSTRACT

A water heater includes a housing, an air box, two windproof hoods, and a catalyst converter. Thus, the catalyst converter converts the carbon monoxide produced during the combustion process of the burner into the carbon dioxide and the water, thereby preventing the waste gas containing the carbon monoxide from causing danger to a user so as to protect the user's safety. In addition, the waste gas containing the carbon dioxide is drained outward from the drain pipe, thereby preventing the waste gas from being gathered in the closed room.

17 Claims, 3 Drawing Sheets

WATER HEATER HAVING WASTE GAS DISPOSAL STRUCTURE

BACKGROUND OF THE INVENTION

1. Field of the Invention

The present invention relates to a water heater, and more particularly to a water heater having a waste gas disposal structure.

2. Description of the Related Art

A conventional water heater comprises a gas burner for heating the water to produce hot water for use with a user so that the user can take a bath by the hot water. However, when the gas burned by the gas burner does not act completely due to an insufficient oxygen content, a waste gas containing the carbon monoxide is produced during the combustion process of the gas burner, so that the user is easily hurt by the carbon monoxide which is colorless and odorless, thereby greatly causing danger to the user located in the closed bath room.

SUMMARY OF THE INVENTION

In accordance with the present invention, there is provided a water heater, comprising a burner, an air box located above the burner, and a catalyst converter mounted in the air box and contacting with a waste gas produced during a combustion process of the burner to convert the waste gas containing a carbon monoxide into a carbon dioxide and water.

The primary objective of the present invention is to provide a water heater having a waste gas disposal structure.

Another objective of the present invention is to provide a water heater, wherein the catalyst converter converts the carbon monoxide produced during the combustion process of the burner into the carbon dioxide and the water, thereby preventing the waste gas containing the carbon monoxide from causing danger to a user so as to protect the user's safety.

A further objective of the present invention is to provide a water heater, wherein the waste gas containing the carbon dioxide is drained outward from the drain pipe, thereby preventing the waste gas from being gathered in the closed room.

A further objective of the present invention is to provide a water heater, wherein the drain pipe is protected by each of the two windproof hoods to achieve a windproof and rainproof effect.

Further benefits and advantages of the present invention will become apparent after a careful reading of the detailed description with appropriate reference to the accompanying drawings.

DETAILED DESCRIPTION OF THE INVENTION

Figure 1:
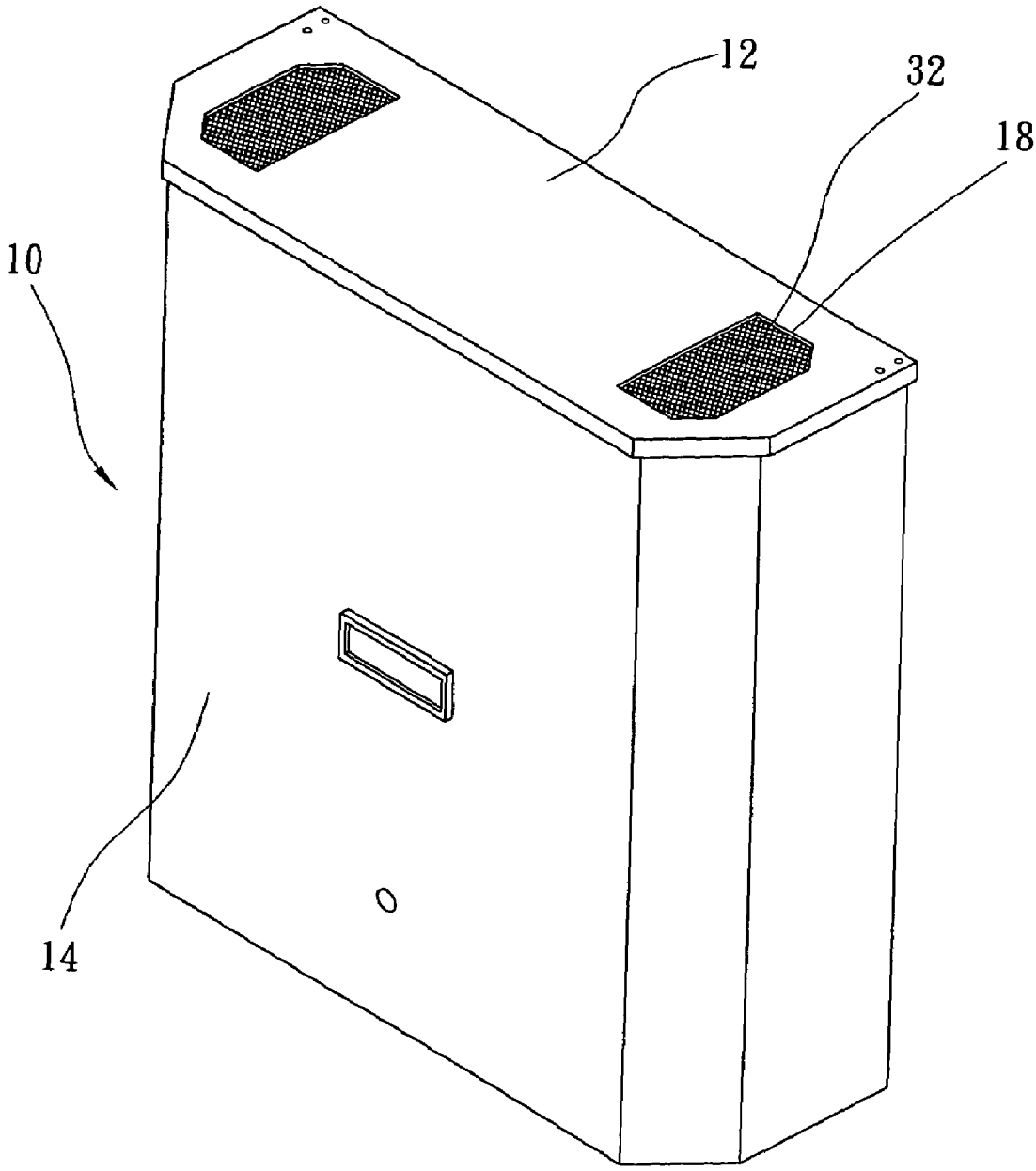
FIG. 1 is a perspective view of a water heater in accordance with the preferred embodiment of the present invention.
Figure 2:
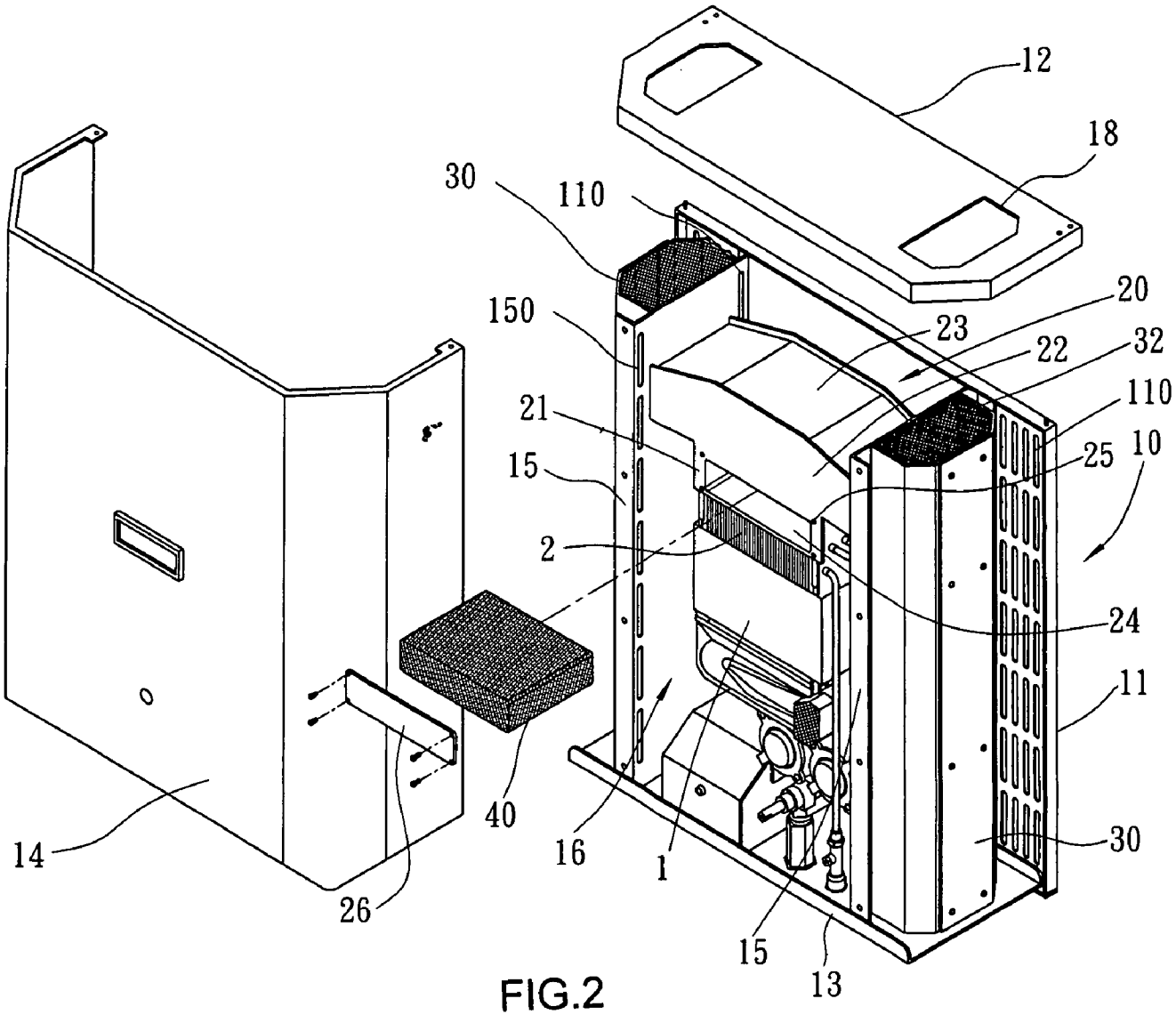
FIG. 2 is an exploded perspective view of the water heater as shown in FIG. 1.

Referring to the drawings and initially to FIGS. 1 and 2, a water heater in accordance with the preferred embodiment of the present invention comprises a housing 10, an air box 20, two windproof hoods 30, and a catalyst converter 40.

Figure 3:
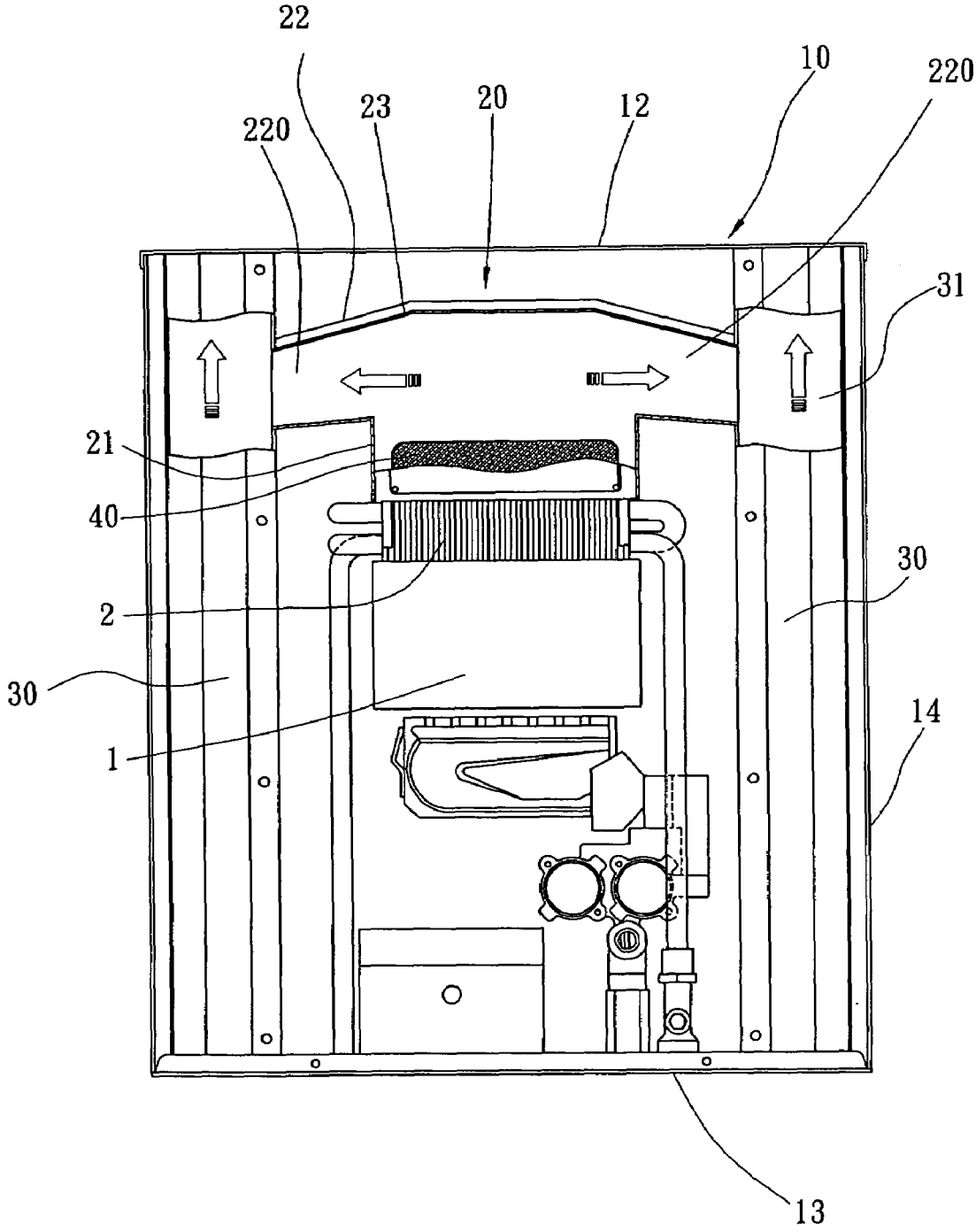
FIG. 3 is a plan cross-sectional view of the water heater as shown in FIG. 1.

Referring to FIGS. 1–3, the housing 10 includes a back plate 11, a top cover 12 mounted on an upper portion of the back plate 11, a bottom cover 13 mounted on a lower portion of the back plate 11, a faceplate 14 mounted between the back plate 11, the top cover 12 and the bottom cover 13, and two upright base plates 15 mounted between the back plate 11 and the faceplate 14, thereby defining a mounting space 16 between the two base plates 15 for mounting a burner 1, a heat exchanger 2, an igniter, an electronic control board and a plurality of water pipes. Each of the two base plates 15 has two sides each formed with a plurality of air inlet holes 150 connected to the mounting space 16, and the back plate 11 has two sides each formed with a plurality of air inlet bores 110 connected to the air inlet holes 150 of each of the two base plates 15 so that the mounting space 16 is connected to the ambient environment through the air inlet holes 150 of each of the two base plates 15 and the air inlet bores 110 of the back plate 11 to supply a sufficient air to the igniter. Each of the top cover 12 and the bottom cover 13 has two ends each formed with a vent hole 18.

The air box 20 is mounted in the mounting space 16 of the housing 10 and located above the heat exchanger 2 to collect the waste gas produced by the burner 1. The air box 20 is substantially T-shaped and has a lower portion formed with a longitudinally arranged inlet manifold 21 located above the heat exchanger 2 to deliver the waste gas produced by the burner 1 and an upper portion formed with a transversely arranged drain pipe 22 connected to the inlet manifold 21 and having two distal ends each extended through the respective base plate 15 and each formed with an outlet hole 220. The drain pipe 22 of the air box 20 has a top plate 23 having a flat mediate portion and two oblique end portions each extended downward toward the respective outlet hole 220 of the drain pipe 22 to introduce the waste gas from the inlet manifold 21 into the respective outlet hole 220 of the drain pipe 22. The inlet manifold 21 of the air box 20 is formed with a transversely arranged channel 24 connected to the drain pipe 22 and located adjacent to the heat exchanger 2. The channel 24 of the inlet manifold 21 has a width substantially equal to a diameter of the inlet manifold 21. The inlet manifold 21 of the air box 20 has a periphery formed with a plurality of screw bores 25 for mounting a cover 26 which covers the channel 24.

Each of the two windproof hoods 30 is mounted on the respective base plate 15 and has an inside formed with a guide channel 31 connected to the respective outlet hole 220 of the drain pipe 22 and connected to the respective vent hole 18 of each of the top cover 12 and the bottom cover 13 so that the drain pipe 22 is connected to the ambient environment through the guide channel 31 of each of the two windproof hoods 30 to drain the waste gas produced by the burner 1 outward from the housing 10. An inclined angle is defined between the guide channel 31 of each of the two windproof hoods 30 and the respective outlet hole 220 of the drain pipe 22 so that the drain pipe 22 is protected by each of the two windproof hoods 30 to achieve a windproof and rainproof effect. Each of the two windproof hoods 30 has two ends each provide with a net 32 to prevent a foreign object from entering the windproof hoods 30.

The catalyst converter 40 is mounted in the air box 20 and in contact with a waste gas produced during the combustion process of the burner 1. Preferably, the catalyst converter 40 is mounted in the channel 24 of the inlet manifold 21 and covered by the cover 26. The catalyst converter 40 contains a catalyst, such as $Cr_2O_3$, CuO, Pt, Pd, Ag, Au and the like.

Thus, when the gas burned by the burner 1 does not act completely due to an insufficient oxygen content to produce a waste gas containing the carbon monoxide, the catalyst converter 40 converts the carbon monoxide into the carbon dioxide and the water, thereby preventing the waste gas containing the carbon monoxide from causing danger to a user so as to protect the user's safety. Then, the waste gas containing the carbon dioxide is drained outward from the drain pipe 22.

Accordingly, the catalyst converter 40 converts the carbon monoxide produced during the combustion process of the burner 1 into the carbon dioxide and the water, thereby preventing the waste gas containing the carbon monoxide from causing danger to a user so as to protect the user's safety. In addition, the waste gas containing the carbon dioxide is drained outward from the drain pipe 22, thereby preventing the waste gas from being gathered in the closed room. Further, the drain pipe 22 is protected by each of the two windproof hoods 30 to achieve a windproof and rainproof effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A water heater, comprising:

a burner;

an air box located above the burner;

a catalyst converter mounted in the air box and contacting with a waste gas produced during a combustion process of the burner to convert the waste gas containing a carbon monoxide into a carbon dioxide and water;

wherein the air box has a lower portion formed with a longitudinally arranged inlet manifold located above a heat exchanger above the burner to deliver the waste gas produced by the burner and has an upper portion formed with a transversely arranged drain pipe connected to the inlet manifold and having two distal ends each formed with an outlet hole.

2. The water heater in accordance with claim 1, wherein the air box is substantially T-shaped.

3. The water heater in accordance with claim 1, wherein the drain pipe of the air box has a top plate having a flat mediate portion and two oblique end portions each extended downward toward the respective outlet hole of the drain pipe to introduce the waste gas from the inlet manifold into the respective outlet hole of the drain pipe.

4. The water heater in accordance with claim 1, wherein the inlet manifold of the air box is formed with a transversely arranged channel connected to the drain pipe for mounting the catalyst converter.

5. The water heater in accordance with claim 4, wherein the channel of the inlet manifold is located adjacent to the heat exchanger.

6. The water heater in accordance with claim 4, wherein the inlet manifold of the air box has a periphery formed with a plurality of screw bores for mounting a cover which covers the channel to cover the catalyst converter.

7. The water heater in accordance with claim 1, wherein the channel of the inlet manifold has a width substantially equal to a diameter of the inlet manifold.

8. The water heater in accordance with claim 1, further comprising a housing including a back plate, a top cover mounted on an upper portion of the back plate, and a bottom cover mounted on a lower portion of the back plate, wherein each of the top cover and the bottom cover has two ends each formed with a vent hole.

9. The water heater in accordance with claim 8, further comprising two windproof hoods each mounted on the two distal ends of the drain pipe and each having an inside formed with a guide channel connected to the respective outlet hole of the drain pipe and connected to the respective vent hole of each of the top cover and the bottom cover so that the drain pipe is connected to an ambient environment through the guide channel of each of the two windproof hoods to drain the waste gas produced by the burner outward from the housing.

10. The water heater in accordance with claim 9, wherein an inclined angle is defined between the guide channel of each of the two windproof hoods and the respective outlet hole of the drain pipe so that the drain pipe is protected by each of the two windproof hoods.

11. The water heater in accordance with claim 9, wherein each of the two windproof hoods has two ends each provide with a net.

12. The water heater in accordance with claim 9, wherein the housing further includes two upright base plates mounted between the back plate and the faceplate, thereby defining a mounting space between the two base plates for mounting the burner and the heat exchanger.

13. The water heater in accordance with claim 12, wherein each of the two windproof hoods is mounted on the respective base plate.

14. The water heater in accordance with claim 12, wherein each of the two distal ends of the drain pipe is extended through the respective base plate.

15. The water heater in accordance with claim 12, wherein each of the two base plates has two sides each formed with a plurality of air inlet holes connected to the mounting space, and the back plate has two sides each formed with a plurality of air inlet bores connected to the air inlet holes of each of the two base plates so that the mounting space is connected to an ambient environment through the air inlet holes of each of the two base plates and the air inlet bores of the back plate.

16. The water heater in accordance with claim 12, wherein the air box is mounted in the mounting space of the housing and located above the heat exchanger to collect the waste gas produced by the burner.

17. The water heater in accordance with claim 8, wherein the housing further includes a faceplate mounted between the back plate, the top cover and the bottom cover.

* * * * *